US006857284B1

(12) United States Patent
Brooks

(10) Patent No.: US 6,857,284 B1
(45) Date of Patent: Feb. 22, 2005

(54) FLUSHING SYSTEM FOR SCREW-TYPE CRUSHED ICE EXTRUSION MACHINE

(75) Inventor: Charles A. Brooks, North Little Rock, AR (US)

(73) Assignee: Chrystal L. Brooks Irrevocable Trust, Tulsa, OK (US)

( * ) Notice: Subject to any disclaimer, the term of this patent is extended or adjusted under 35 U.S.C. 154(b) by 0 days.

(21) Appl. No.: 10/695,341

(22) Filed: Oct. 28, 2003

(51) Int. Cl.[7] ..... F25C 1/14
(52) U.S. Cl. ..... 62/303; 62/354
(58) Field of Search ..... 62/303, 354

(56) References Cited

U.S. PATENT DOCUMENTS 3,638,448 A 2/1972 Raymer ..... 62/233
3,733,840 A * 5/1973 Pearl et al. ..... 62/78
5,289,691 A 3/1994 Schlosser et al. ..... 62/78
6,311,501 B1 11/2001 Allison et al. ..... 62/74
6,347,529 B1 2/2002 Yamamoto ..... 62/354
6,725,675 B2 * 4/2004 Kampert et al. ..... 62/71

* cited by examiner

*Primary Examiner*—William E. Tapolcai
(74) *Attorney, Agent, or Firm*—Head, Johnson and Kachigian

(57) ABSTRACT

An improved apparatus and method for flushing an auger-type crushed ice making machine prevents build up of scale and other contaminants. The system feeds a flushing liquid to the top of the extrusion head such that it flows down through the device, thereby cleaning the auger and sleeve. The flushing liquid may be water or a solution having chemicals that help to remove built up scale or other contaminants.

5 Claims, 4 Drawing Sheets

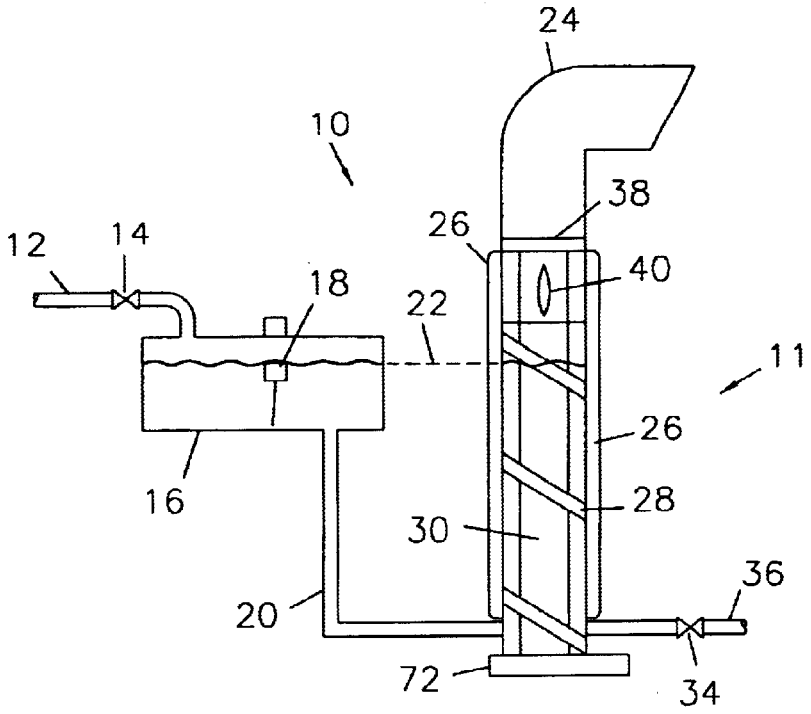
Fig.1 – Prior Art
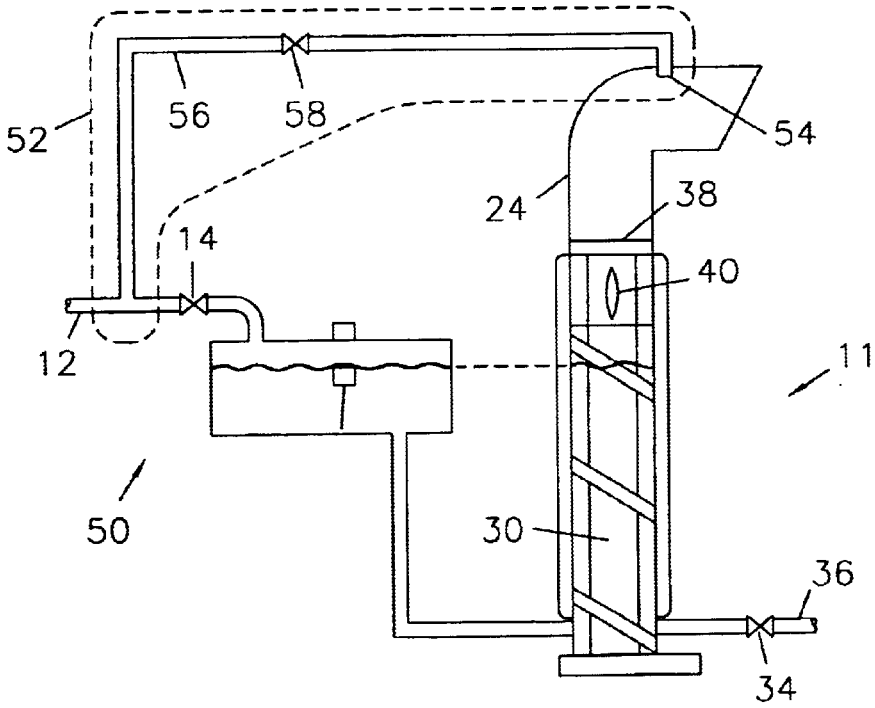
Fig.2

FLUSHING SYSTEM FOR SCREW-TYPE CRUSHED ICE EXTRUSION MACHINE

BACKGROUND OF THE INVENTION

1. Field of the Invention

The present invention relates to an improved system for flushing a crushed ice extrusion machine. Specifically, the present invention provides a flushing mechanism that supplies rinse water or solution to the top of the extrusion head such that it rinses the extrusion head and screw portion of the machine in a flow through manner. The improved flushing device thoroughly removes all contaminants from the entire crushed ice extrusion machine.

2. Prior Art

Screw-type extrusion machines for making crushed ice are well known in the art. They typically consist of a screw or auger device positioned vertically inside a sleeve. The screws of the auger are flush with the inside of the sleeve. The sleeve is surrounded by a cooling jacket. Resting on top of the auger device is an extrusion head. The extrusion head is cylindrical and has a series of radially extended bosses that form channels. A reservoir feeds water into the bottom of the sleeve and continuously fills the sleeve to the top. A motor then begins rotating the auger. Once the auger is actuated, the cooling jacket is turned on so that it brings the water inside the sleeve to the freezing point. The rotating motion of the auger pushes ice upward as it is formed. The result is a constant, cylindrical sheet of ice pushed upward past the auger and forced into the channels of the extrusion head. Rods or fingers of frozen ice are thereby extruded upwardly out of the channels of the extrusion head. These rods or fingers are then broken up into individual pieces of crushed ice by any number of methods known to those skilled in the art. The resulting crushed ice is then deposited into a chamber from which it may be withdrawn and used.

To avoid build up of scale, pathogens and other chemicals and contaminants, the device must be periodically flushed. Failure to adequately flush out the device results in buildup of scale and other contaminants. This can lead to poor quality ice, and/or back load on the motor that operates the auger. These may result in the auger and/or extrusion head becoming jammed by the ice flowing through them. This is known as a "freeze up". Such a freeze up can severely damage or destroy one or more parts of the crushed ice making machine. This results in substantial down time for the ice making machine as well as the cost of repairs.

Several solutions have been tried to avoid back load build up, scale build up and freeze ups. Improved coating for the auger, sleeve and extrusion heads make these parts smoother and more resistant to scale build up and clogging of the extruded ice. In addition, various chemicals may be added to the water utilized when flushing out the device. Weak acids have both an antiseptic and a descaling effect.

In existing crushed ice extrusion machines, the device is flushed in the following manner. First, the cooling jacket is turned off in order to allow ice within the device to melt. Next, the auger is turned off. A solenoid or other type of drain valve is opened and the water within the device is drained through a drain pipe. This typically takes 30–40 seconds. Finally, the device is allowed to sit for a given amount of time, typically 20–30 minutes. This allows the ice in the extrusion head to melt and drain through the drain pipe. As the ice in the extrusion head melts, it flows through the sleeve, further rinsing it. The device is then turned back on and production of crushed ice continues. The present method of flushing these devices allows for only minimal flushing of the extrusion head itself. While it greatly reduces scaling, contamination and freeze up, all of these deleterious events still occur evenutally.

It is therefore an object of the present invention to provide an improved method for flushing a crush ice extrusion machine.

SUMMARY OF THE INVENTION

The present invention provides an improved flushing system for use in crushed ice extrusion machines that may be readily incorporated into existing machines. A separate flushing system is provided that administers water into the device above the extrusion head. Once the rinse water has been removed during the flushing process, the ice in the extrusion head is allowed to melt for a preset period of time. Typically, this is about 5 minutes. This allows the ice in the extrusion head to partially melt and loosen somewhat. A steady stream of water is then applied to the top of the extrusion head. This accelerates the melting of the ice within the extrusion head. Once the flushing is over, flushing of the extrusion head ceases and the machine resumes operation.

A continuous flushing of the device from the top results in a far superior cleansing of not only the extrusion head but the auger system as well. Those skilled in the art will appreciate that existing flushing systems only minimally reduce scale build up in the extrusion head because flushing of the extrusion head is minimal. The present invention flushes the auger and sleeve far more thoroughly. With existing flushing systems, it is still necessary to periodically remove extrusion heads so that scale may be removed manually. The present invention avoids this, reducing down time and maintenance costs.

It may also be desirable to use a solution of chemicals in place of plain water when flushing the device. Those skilled in the art will appreciate that there are a number of compounds that may be added to water that have either an antiseptic or descaling effect, or both. This is especially desirable in locations having relatively hard water.

It is therefore an object of the present invention to provide a superior method of flushing a crushed ice extrusion machine that substantially decreases maintenance costs.

BRIEF DESCRIPTION OF THE DRAWINGS

FIG. 1 is a schematic diagram of a crushed ice extrusion machine of the prior art.

FIG. 2 is a schematic diagram of a crushed ice extrusion machine including the flushing system of the present invention.

DETAILED DESCRIPTION OF THE PREFERRED EMBODIMENTS

Figure 3:
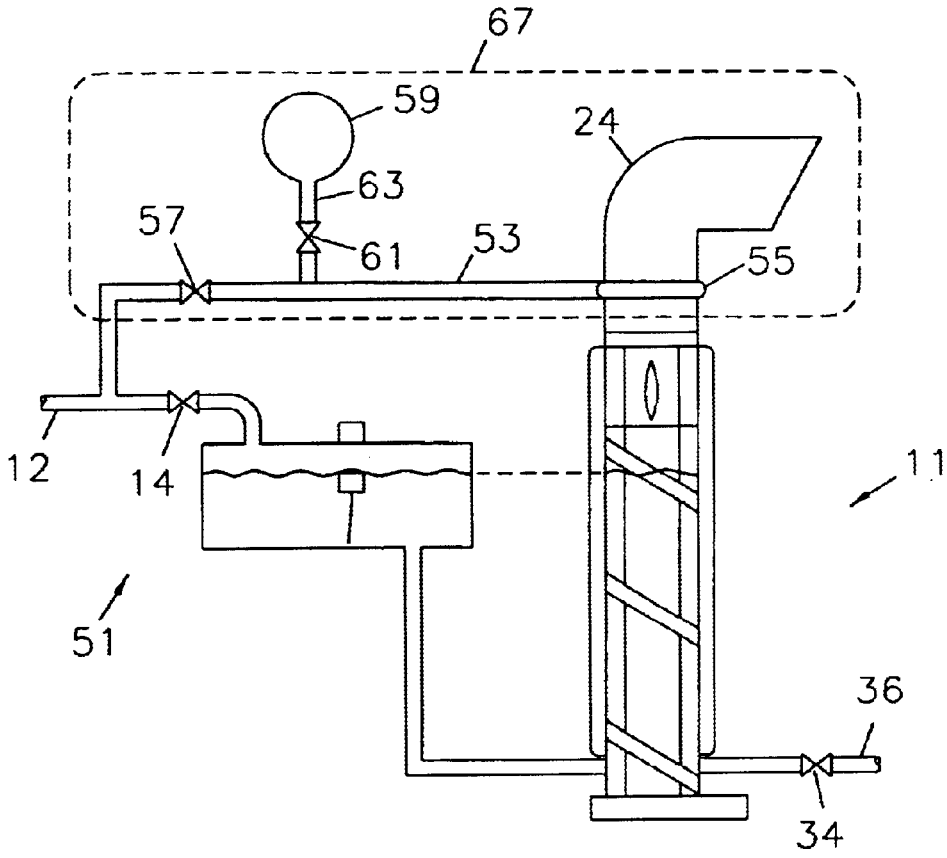
FIG. 3 is a schematic diagram of an alternative embodiment of the present invention.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention provides an improved flushing system for crushed ice making machines. It provides a much more effective and thorough method for flushing the ice forming portion of the device. In existing ice making machines, devices are flushed by simply turning off the water supply and draining the water from the auger portion of the machine. The extrusion head itself is not flushed. The only cleansing of the extrusion head is the minimal amount provided by the melting of the ice within it. Those skilled in the art will appreciate that a significant amount of scale builds up in the extrusion head. Currently, this scale is only removed by disassembling the device, removing the extrusion head, cleaning it separately and then re-inserting it. This requires a significant amount of down time and labor. The improved flushing system of the present invention flushes the system by supplying water or a cleaning agent to the top of the device. The fluid then flows over the extrusion head and through the auger system and is drained. This provides far superior cleaning and flushing of the device. While the prior art merely briefly soaks the auger system and provides no rinsing of the extrusion head, the present invention provides a continuous, flow through rinsing of the entire device. Those skilled in the art will appreciate that this is a significant improvement over the existing technology.

Crushed ice machines as referred to herein include all extrusion ice machines know by a number of names in the art. Crushed ice is interchangeably known as snow ice, flake ice and nugget ice. Those skilled in the art will appreciate that the improved flushing system described herein is suitable for any continuous flow extrusion ice machine.

In FIG. 1, a typical auger-type crushed ice extrusion machine 10 is shown. Water is supplied by inlet pipe 12 into reservoir 16. Reservoir 16 has a float switch 18 that regulates inlet valve 14. When float switch 18 detects that the water in reservoir 16 has fallen below the designated water level 22, it sends a signal to open valve 14. Once the water reaches level 22, valve 14 is closed. Those skilled in the art will appreciate that this is accomplished automatically by a control system not shown. Water is fed from reservoir 16 into the ice forming portion of the device by supply pipe 20. The ice making portion of the device 11 is comprised of a sleeve 28 surrounded by cooling jacket 26. Within sleeve 28 is auger screw 30 that is actuated so as to rotate by gear box 32. Gear box 32 is powered by a motor not shown. Ice formed in portion 11 also includes extrusion head 40. Those skilled in the art will appreciate that this is a typical crushed ice forming device. Jacket 26 is typically comprised of a coil through which a refrigerant, such as Freon is pumped. The cooling effect of jacket 26 brings the water within device 11 to the freezing point or lower. As auger turns, the ice that is formed is pushed into extrusion head 40. When enough ice is pushed through extrusion head 40, the water level drops below the designated level 22 which causes flotation switch 18 to activate valve 14 to supply additional water. In this manner, water is constantly supplied to device 11. Crushed ice is forced through extrusion head 40 into chute 24 in which it is supplied to a storage bin. Chute 24 is removably attached to device 11 by an annular collar 38.

Ice machine 10 is programmed to be flushed periodically. It is common for the machine's controls, not shown, to be programmed to flush the device 11 every 12 hours. Typically, the cooling mechanism of jacket 26 is turned off. This stops formation of ice. Auger 30 continues to rotate in order to stir the water within device 11 in order to clean auger 30 and sleeve 28. After a designated time period, typically one or two minutes, auger 30 is stopped so that it no longer spins. Valve 34 is then opened so as to allow the water to drain from device 11. Extrusion head 40 will still have a substantial amount of ice in it. For this reason, the flush cycle ends with a 20 or 30 minute period in which the machine is entirely turned off. This allows the ice within extrusion head 40 to melt and drain through pipe 36. Those skilled in the art will appreciate that any rinsing of extrusion head 40 by the melting ice is minimal at most. This results in significant build up of scale and other contaminants on the extrusion head.

To overcome the shortcomings of the prior art, the present invention provides a means of flushing the crushed ice machine from the top. This is far superior to the prior art in that it provides a means of a continuous flow-through flushing. The flushing system of the prior art consists of little more than briefly soaking the device.

FIG. 2 shows modified ice machine 50 that incorporates the present invention into the device shown in FIG. 1. Improved ice machine 50 includes flushing system 52. When the ice forming portion 11 of device 50 is to be flushed, the flushing process begins in the same fashion as in the prior art. Once auger 30 stops turning and the water is drained through pipe 36 after valve 34 is opened, a significant amount of ice remains in extrusion head 40. The device is set to allow about five minutes to elapse. This causes the ice to begin to melt and somewhat loosen. After the set time period, valve 58 is opened allowing water to flow through flushing pipe 56 and out of nozzle 54. The water falls onto the extrusion head and accelerates the melting of the ice. As the ice melts, the water sprayed from nozzle 54 flows down through device 1, over extrusion head 40 and auger 30. After a designated period of time, valve 58 is closed, ending the flushing process. Valve 34 is then also closed, valve 14 is re-opened and the ice machine is restarted. By thoroughly rinsing the extrusion head, scale build up and the presence of other contaminants is substantially reduced.

FIG. 3 shows an alternative embodiment of the invention. Ice machine 51 is a modified version of the typical prior art ice machine shown in FIG. 1. It includes an improved flushing system 67. It operates in a way very similar to that described in FIG. 2. It comprises flushing pipe 53 attached to water inlet 12 by valve 57. Ring 55 circles chute 24 and is described in more detail in FIG. 6. Flushing system 67 also comprises solution reservoir 59 attached to flushing pipe 53 by supply pipe 63. Supply pipe 63 contains valve 61. Flushing system 67 is controlled in the same manner as flushing system 52 shown in FIG. 2. However, once valve 57 is opened at a designated time after the flushing cycle starts, valve 61 is opened to allow a solution in reservoir 59 to flow through supply pipe 63 and commingle with the water flowing through flushing pipe 53. For a designated time period, valve 61 remains open. At least a few minutes prior to the end of the flush cycle, valve 61 is closed. Water continues to flow through flushing pipe 53 and through ice making device 11 in order to flush out any remaining solution. The solution may be comprised of any of a number of chemicals known in the art that either facilitate de-scaling, remove pathogens or other contaminants or both. In a preferred embodiment, the solution in reservoir 59 is citric acid. Citric acid is harmless and therefore a safer cleaning agent. It also has de-scaling and antiseptic qualities.

Those skilled in the art will appreciate that there are a wide variety of weak acids that are also suitable, such as acetic acid and ascorbic acid. Such a system is especially desirable when relatively hard water is being used to make ice, thereby increasing the amount of scale deposits.

Another advantage of the present invention is that it at least partially rinses the chute from which the ice is ejected. Although this does not entirely replace manual cleaning of the chute, it maintains a cleaner environment between cleanings.

Figure 4:
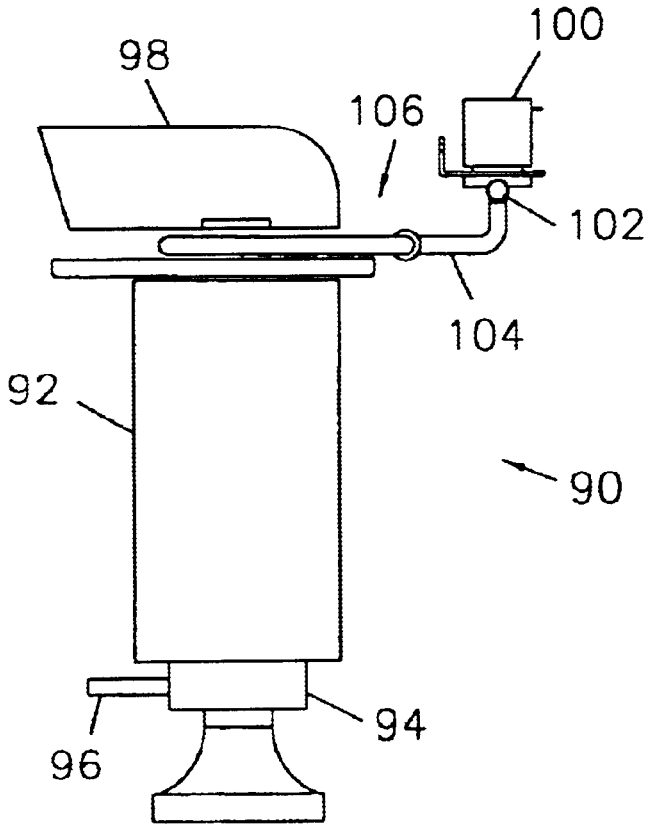
FIG. 4 is a side view of an alternative embodiment of the present invention.

FIG. 4 shows a side view of an alternative embodiment of the invention. Ice forming device 90 is comprised of a jacket 92 and a sleeve 94. Within sleeve 94, but not shown, is a screw-type auger and extrusion head as shown in the previous figures. Water is supplied by inlet valve 96. Ice is ejected from the device through chute 98. In existing prior art ice machines, chute 98 was attached directly to sleeve 94. In this particular embodiment, flushing system 106 is installed between chute 98 and the rest of the device. Those skilled in the art will appreciate that chute 98 is readily removable from sleeve 94 for periodic cleaning. Therefore, incorporating flushing system 106 into an existing ice machine is a relatively simple matter. Inlet 102 is attached to a water supply. Valve 100 regulates the injection of water into the ice forming machine 90 through flushing pipe 104 and flushing system 106. In this particular embodiment, valve 100 is a solenoid valve. However, those skilled in the art will appreciate that a wide variety of valves, for example butterfly valves, are also suitable.

Figure 5:
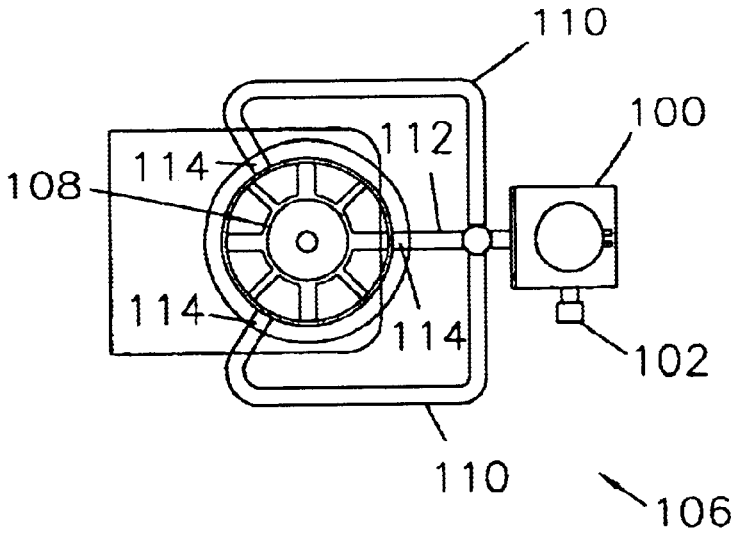
FIG. 5 shows a diagrammatic top view of the alternative embodiment shown in FIG. 4.

FIG. 5 shows a top view of flushing system 106 also illustrated in FIG. 4. It can be seen that flushing system 106 comprises two lateral arms 110 and a central arm 112. At the end of each of these arms is a nozzle 114. When water is supplied to flushing system 106, it travels through each of these arms and through nozzles 114 and enters extrusion head 108. Using multiple nozzles provides for a more even distribution of the flushing water or solution. In this particular embodiment, the nozzles are directed horizontally. Those skilled in the art will appreciate that it will be equally effective to have the nozzles pointed slightly downward and more directly toward the extrusion head.

Figure 6:
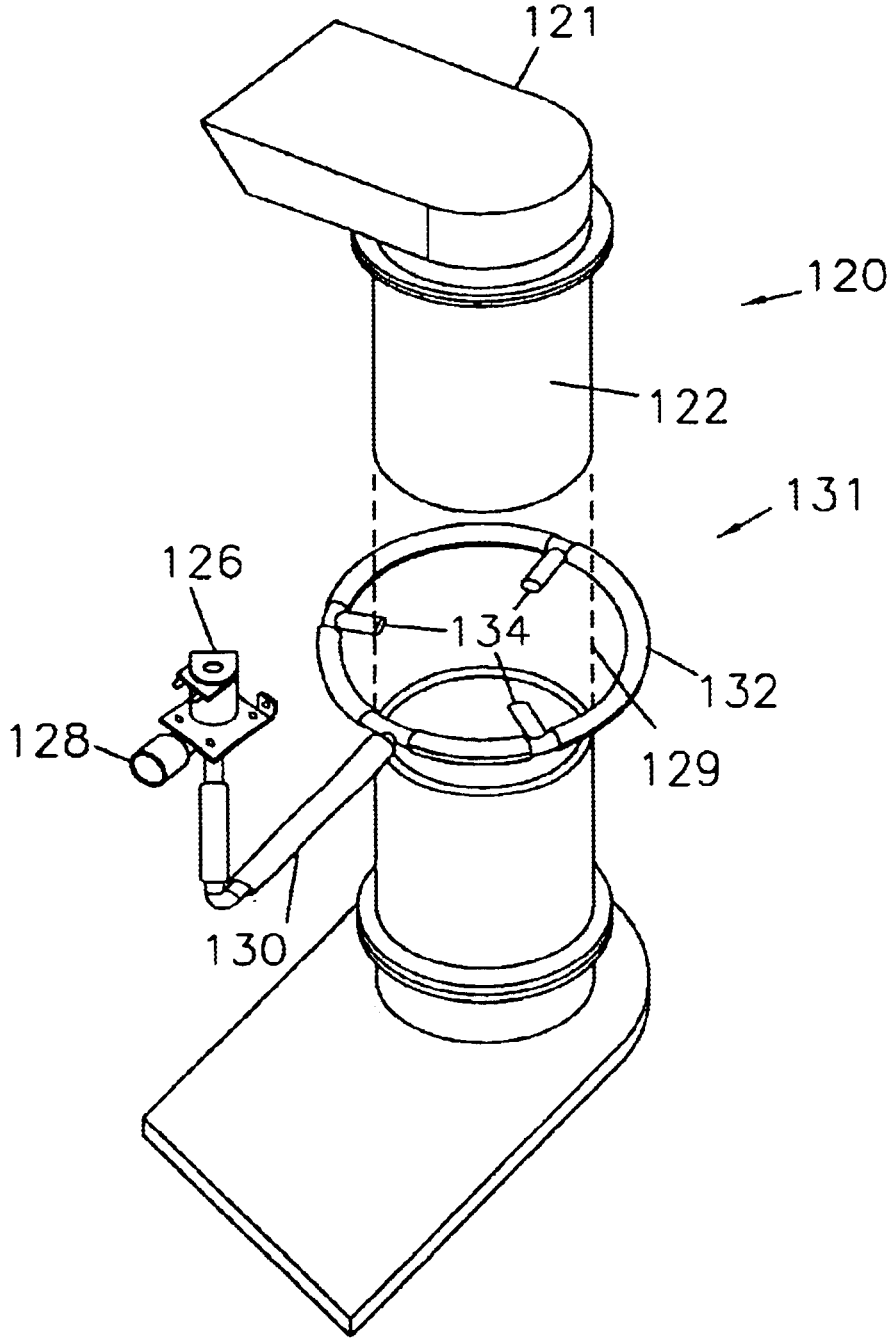
FIG. 6 is a diagrammatic representation of an alternative embodiment of the present invention.

FIG. 6 shows an alternative flushing system 131 that may be used for the present invention. This is a more detailed view of the type of flushing system illustrated in FIG. 3 as flushing ring 55. Ice ejecting chute 120 is comprised of directional tube 121 that directs ice to be ejected in a particular direction. Chute 120 also includes tube 122. A central portion 124 of tube 122 is cut away in order to more clearly show flushing system 131. Flushing system 131 has an inlet port 128 into which water or solution is supplied to the system 131. Valve 126 regulates when water is to be supplied to the rest of the system and into chute 120. As with the embodiment shown in FIGS. 4 and 5, valve 126 is also a solenoid valve. As with the previously described embodiments, this is only one of many possible valves that are suitable. Flushing pipe 130 supplies water or solution to flushing ring 132. From ring 132 the water is supplied to nozzle 134 which injects the water or solution into chute 120. The liquid then travels down the walls of tube 122 and into an ice forming device (not shown).

The above figures illustrate a few of the many possible methods by which a flushing liquid may be applied to the top of an ice forming device. The device as depicted in FIG. 2 is probably the most easily adaptable to existing ice machines. This illustrates one of the advantageous of the present invention, that it is readily applied to existing ice making systems and very little time and effort is required to attach it to a prior art machine.

Whereas, the present invention has been described in relation to the drawings attached hereto, it should be understood that other and further modifications, apart from those shown or suggested herein, may be made within the spirit and scope of this invention.

What is claimed is:

1. A device for flushing an auger-type ice making machine having an extrusion head comprising:

a flushing pipe that is connected to a water supply;

a valve for regulating the entry of water from the water supply to the flushing pipe; and at lease one flushing nozzle attached to the flushing pipe and located above the extrusion head of an auger-type ice making machine such that a liquid sprayed by the nozzle is applied to the extrusion head.

2. A device of claim 1 wherein at least one flushing nozzle comprises a plurality of flushing nozzles.

3. The device of claim 1 further comprising:

a cleaning solution reservoir having a cleaning solution within it;

a supply pipe connecting the cleaning solution reservoir to the flushing pipe;

a valve for regulating the entry of the cleaning solution from the cleaning solution reservoir to the flushing pipe.

4. The device of claim 3 wherein the cleaning solution comprises citric acid.

5. The device of claim 2 further comprising a flushing system that is connected to both the flushing pipe and the plurality of nozzles.

* * * * *